US005317765A

United States Patent [19]

Knoedler et al.

[11] Patent Number: 5,317,765

[45] Date of Patent: Jun. 7, 1994

[54] COLLAPSIBLE INFANT BATH RING

[75] Inventors: Roy E. Knoedler, Boulder; T. Brent Freese, Westminster; Patrick M. Bertsch, Thornton, all of Colo.

[73] Assignee: Gerry Baby Products Company, Denver, Colo.

[21] Appl. No.: 941,742

[22] Filed: Sep. 8, 1992

[51] Int. Cl.[5] ..... A47K 3/024

[52] U.S. Cl. ..... 4/572.1; 4/571.1; 297/467; 297/411.4; D23/304

[58] Field of Search ..... 4/572.1, 573.1, 578.1, 4/579, 585, 586, 587, 590; 297/418, 467, 5; D6/333, 344, 349, 477, 339; D23/303, 304

[56] References Cited

U.S. PATENT DOCUMENTS

| | | | |
|---|---|---|---|
| D. 288,118 | 2/1987 | Boucher | D23/69 |
| D. 320,528 | 10/1991 | Bernstein et al. | D6/333 |
| D. 327,777 | 7/1992 | Tepper | 4/572.1 |
| 2,379,340 | 6/1945 | Corbett | 4/185 |
| 3,009,733 | 11/1961 | Gelman | 297/5 |
| 3,031,229 | 4/1962 | Symbaluk | 297/390 |
| 3,065,028 | 11/1962 | Irion | 297/467 |
| 3,290,090 | 12/1966 | Ford | 4/578.1 |
| 3,857,604 | 12/1974 | Scott | 297/418 |
| 3,995,331 | 12/1976 | Fotre et al. | 4/185 |
| 4,650,246 | 3/1987 | Henriksson | 297/467 |
| 4,837,871 | 6/1989 | Wheeler | 4/546 |
| 5,010,606 | 4/1991 | Bernstein et al. | 4/572 |
| 5,056,776 | 10/1991 | Cheng | 297/5 |

OTHER PUBLICATIONS

Products Disclosed by Pansy Ellen at 1991 JPMA Trade Show "Accessories"—1 page.

*Primary Examiner*—Henry J. Recla
*Assistant Examiner*—Charles R. Eloshway
*Attorney, Agent, or Firm*—Biebel & French

[57] ABSTRACT

A bath ring is provided which is collapsible from a use to a storage position whereby the bath ring may be reconfigured to a compact configuration. The bath ring includes a base portion, a ring portion pivotally mounted to the base portion, a support post for supporting a rear section of the ring portion in spaced relationship to the base portion, and a T-shaped restraining bar pivotally mounted to the base portion and forming a front restraint which may be pivoted out of the way to place an infant on the base portion. In its collapsed position, the support post may be pivoted to a location underneath the base portion and the ring portion and T-shaped restraint may be pivoted rearwardly and downwardly toward the base portion.

16 Claims, 5 Drawing Sheets

COLLAPSIBLE INFANT BATH RING

BACKGROUND OF THE INVENTION

This invention relates to a bath ring for supporting an infant and, more particularly, to a bath ring for supporting an infant in an upright sitting position wherein the bath ring may be collapsed to a compact configuration for storage when not in use.

Several devices have been proposed for supporting infants while taking a bath in a conventional bathtub. Such devices have typically included a ring or support rail for surrounding the infant and support posts for supporting the ring at a predetermined height. The post may be supported by a base forming a seat for the infant or may be attached directly to the bathtub bottom by means of suction cups. Examples of such devices are shown in U.S. Pat. Nos. 5,010,606 to Bernstein et al and Design 288,118 to Boucher.

Other known bath seat structures have consisted of a seat structure which incorporates straps for holding the infant in position. U.S. Pat. No. 3,031,299 to Symbaluk discloses a seat in the form of a shell for surrounding the infant wherein a cross bar extends between opposing sides of the seat and a central crotch belt extends from the cross bar to the seat to retain the infant behind the cross bar. Finally, U.S. Pat. No. 3,995,331 to Fotre et al discloses an infant bath and lounging seat designed to support an infant in a lounging position and including straps for retaining the infant to the seat. The device may be folded in half to form a carrying case when the seat is not in use.

While the known bath seats are effective for their designed purpose for supporting infants in a bath tub, these devices have proven to be difficult to store in that the raised sides for forming a support around the infant must be spaced a predetermined distance from the seat portion and therefore necessarily take up an inordinate amount of storage space when the bath seat is not in use. Although the device of Fotre et al discloses a lounge seat which may be folded into a carrier configuration when not in use, this seat does not include the structure required to support an infant in an upright sitting position and therefore does not address the particular problems associated with bath seats incorporating a ring for surrounding and supporting an infant in a sitting position.

Accordingly, there is a need for a bath seat or ring which is adapted to support an infant within a bathtub in an upright sitting position wherein the bath ring may be collapsed to a compact configuration for storage purposes.

SUMMARY OF THE INVENTION

The present invention provides a collapsible bath ring comprising a base portion, a ring portion having a back portion for supporting the back of a person seated on the base portion, and attachment means connecting the ring portion to the base portion wherein the ring portion is adapted to pivot about the attachment means toward the base portion for collapsing the bath ring into a compact storage position.

In addition, a support means in the form of a support bar is attached to the base portion at a rear edge thereof and extends between the base portion and the ring portion to support the ring portion and form a back support when the support means is in a support position. The support means is movable to a non-support position to permit the ring portion to move about the attachment means into the collapsed storage position.

The ring portion includes a first section for surrounding a person seated on the base portion and a pair of second sections extending downwardly from the first section to the attachment means. The support means engages the first section of the ring portion to limit pivotal movement of the ring portion in the support position of the support means. In addition, a T-shaped bar forming a restraining means for restraining a person from sliding forwardly off the base portion is pivotally mounted to the base portion and extends upwardly into engagement with the ring portion at a juncture between the first section and the second sections.

When the support means is disengaged from the ring portion, it may be pivoted into engagement within a slot formed in a lower surface of the base portion for storage. In addition, the ring portion may be pivoted into a position wherein the first section is adjacent to and surrounds a rear edge of the base portion, and the T-shaped bar may be pivoted rearwardly and downwardly with the ring portion. In the collapsed position, the base portion, ring portion and T-shaped bar form a substantially triangular configuration, when viewed from the side, such that the bath ring is in a compact form for storage in an out of the way location such as under a sink.

Therefore, it is an object of the present invention to provide a bath ring for supporting a person, such as an infant, in an upright sitting position.

It is a further object of the invention to provide a bath ring which may be collapsed to a compact form.

Other objects and advantages of the invention will be apparent from the following description, the accompanying drawings, and the appended claims.

DETAILED DESCRIPTION OF THE PREFERRED EMBODIMENT

Figure 1:
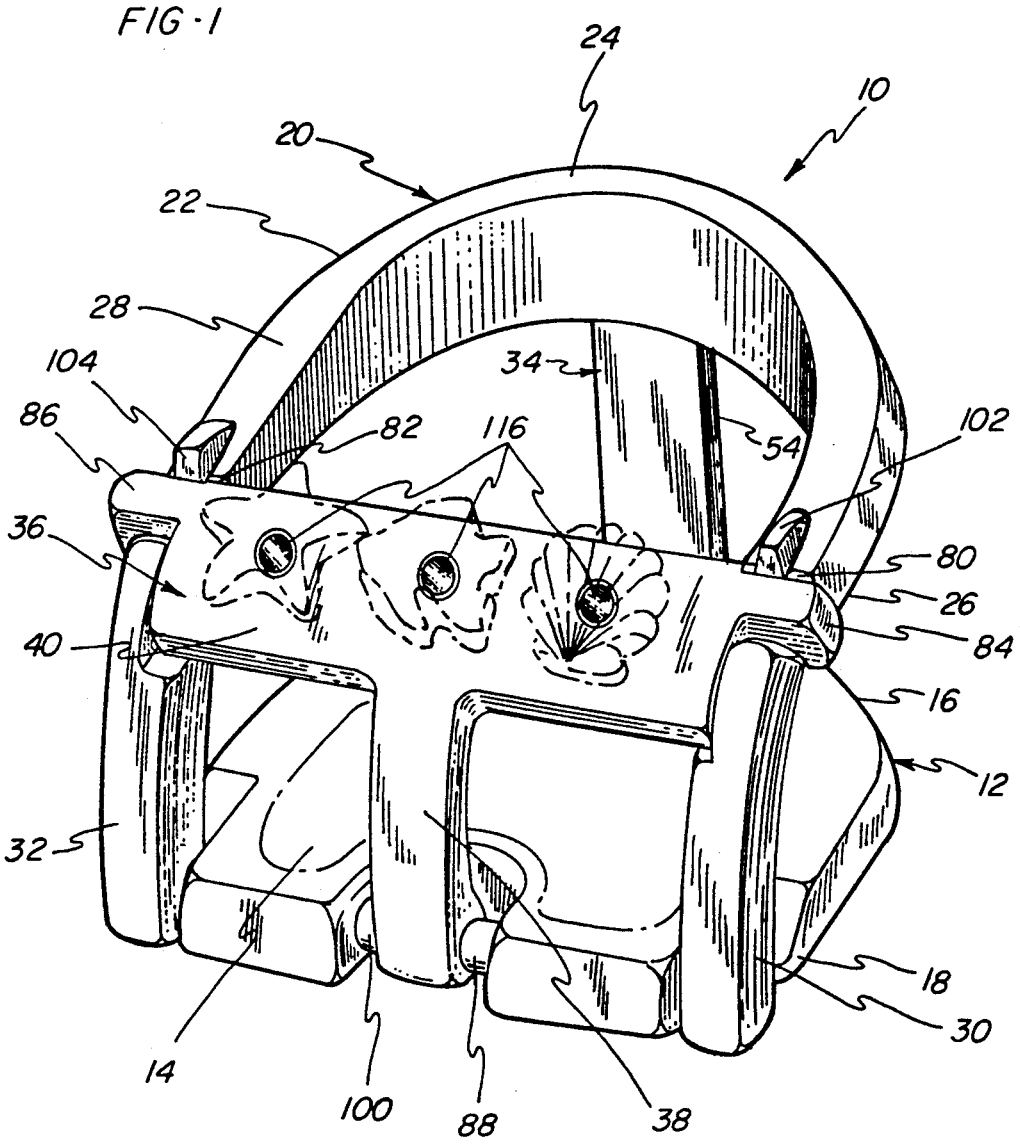
FIG. 1 is a perspective view of the bath ring of the present invention.
Figure 2:
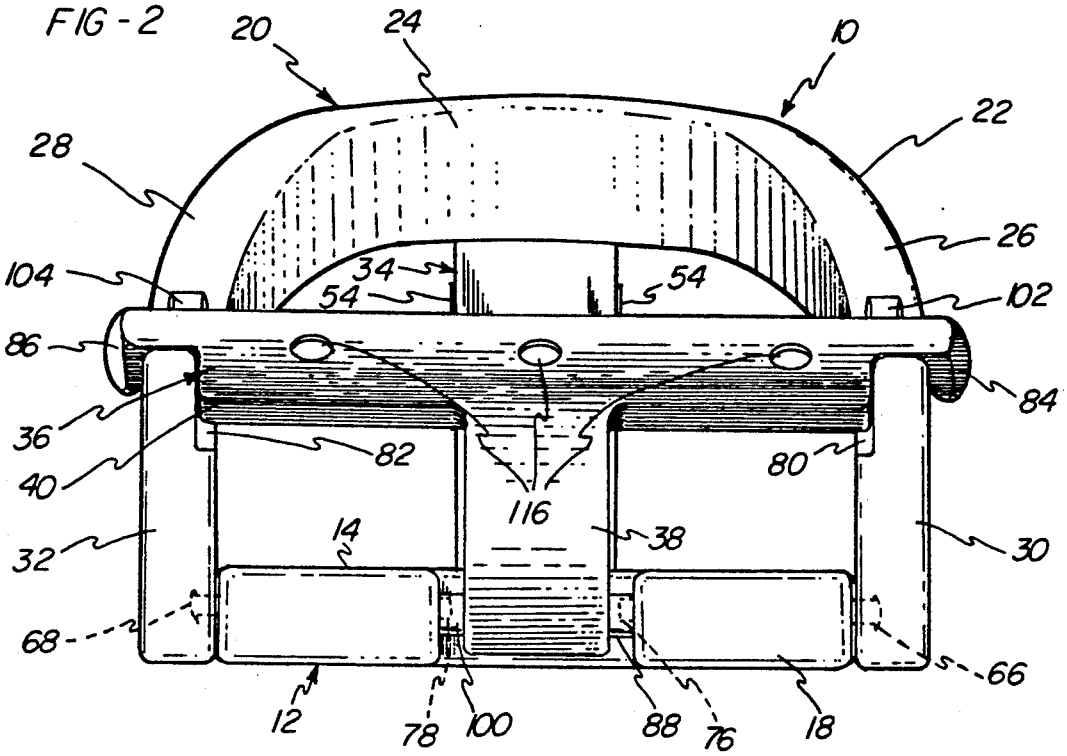
FIG. 2 is a front elevational view of the bath ring partially cut away to show the pivot connection for the ring and support portions.
Figure 3:
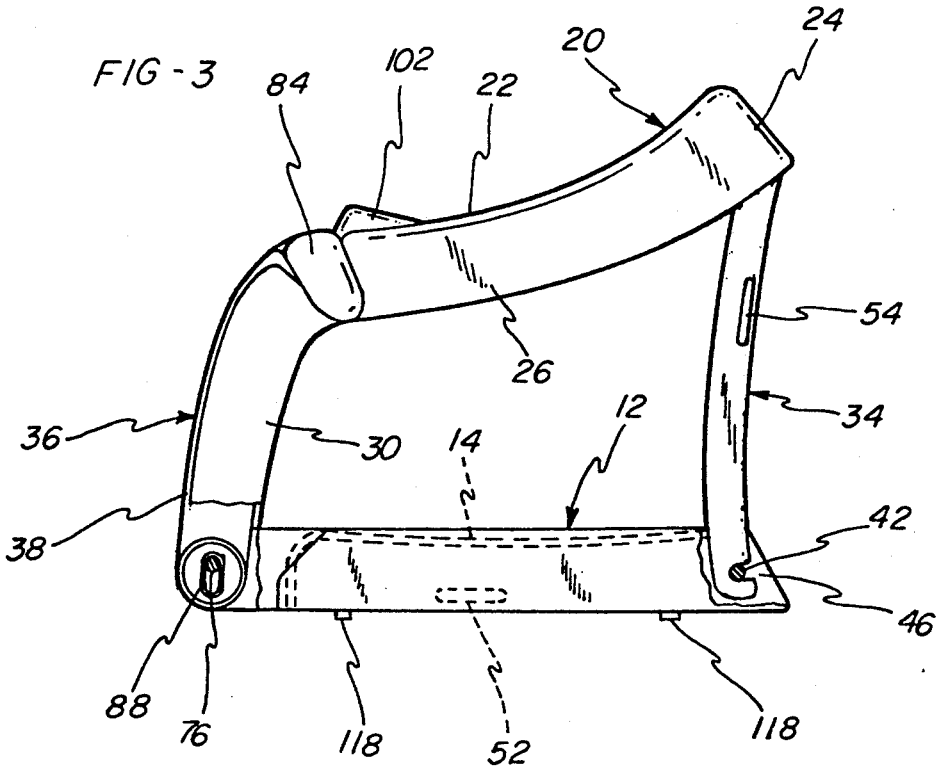
FIG. 3 is a side elevational view of the bath ring.

Referring to FIGS. 1–3, the present invention provides a bath ring 10 for supporting a person in an upright sitting position. The bath ring 10 includes a base portion 12 having an upper support surface 14, a curved back section 16 and a squared off front section 18.

A ring portion 20 is provided including a first section 22 defined by a curved back section 24 and first and second arm sections 26, 28 extending forwardly from the back section 24. The ring portion 20 further includes a second section defined by first and second leg sections 30, 32 extending downwardly from the first and second arm sections 26, 28. The leg sections 30, 32 are attached to the seat portion 12 at pivot connections, as will be described further below.

A support means in the form of a rear post 34 is pivotally mounted to the seat portion 12 at a pivot connection and an upper portion of the rear post 34 engages the curved back section 24 of the ring portion 20 in order to support the ring portion 20 in a predetermined spaced relationship from the base portion 12. In addition, a T-bar 36 including a vertical section 38 and a horizontal section 40 is pivotally attached to a front edge of the base portion 12 for movement toward and away from the ring portion 20.

Further, it should be noted that each of the components forming the bath ring 10 is preferably formed of a plastic material such that the bath ring 10 is adapted to be repetitively used in water without corroding.

Figure 4:
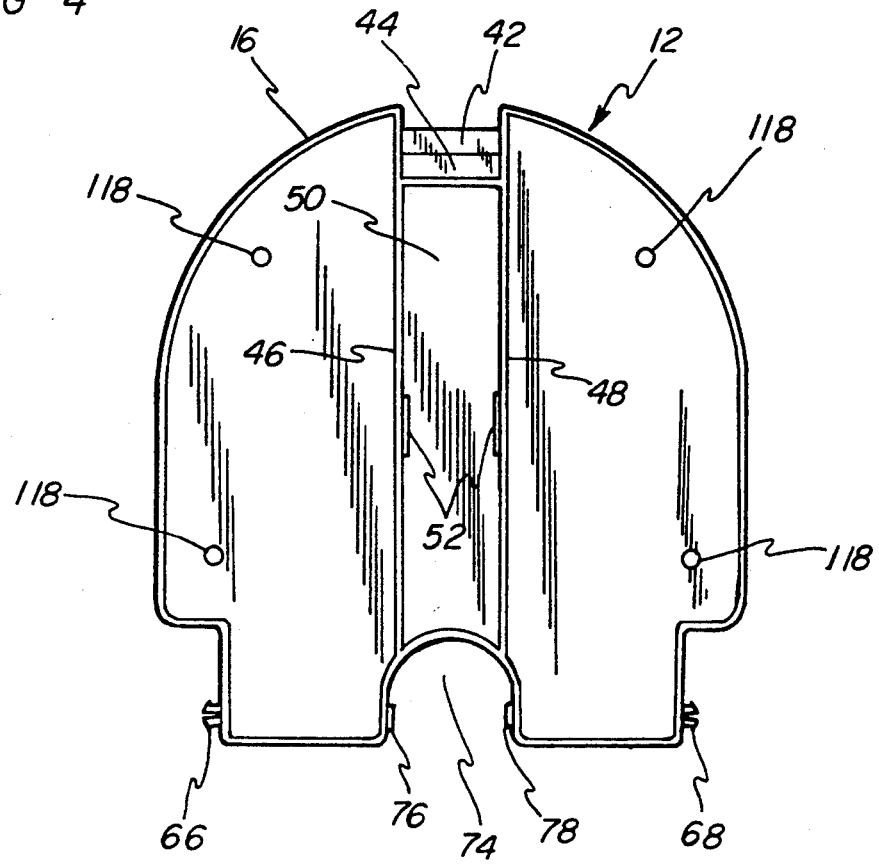
FIG. 4 is a bottom plan view of the base portion of the bath ring.
Figure 7:
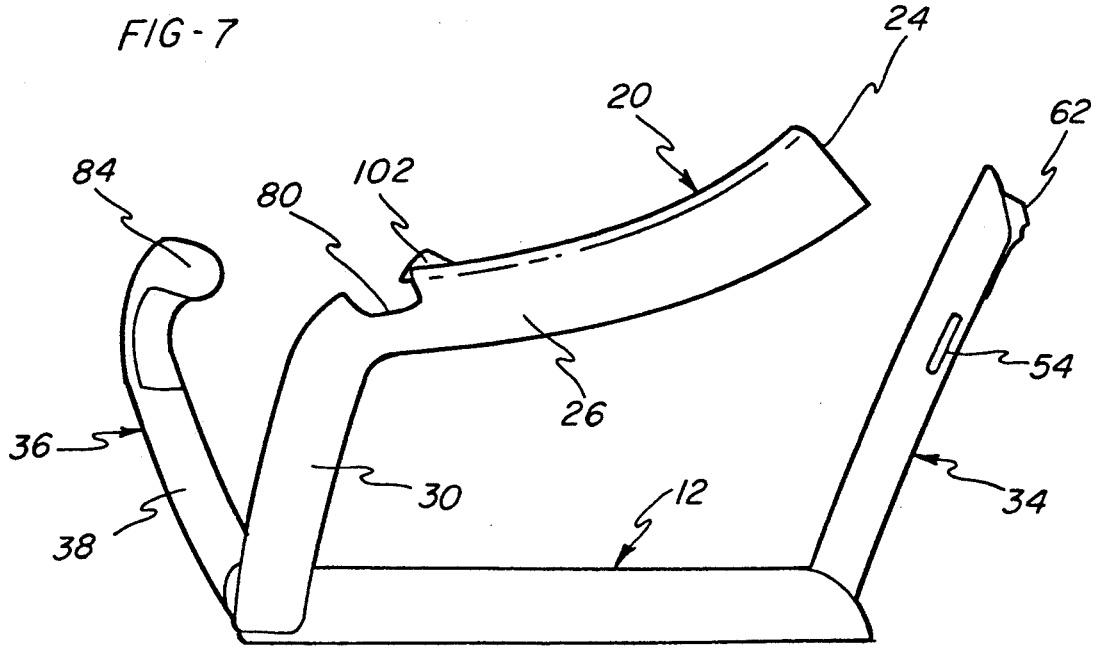
FIG. 7 is a side elevational view showing the T-bar and support portion in pivoted relationship to the ring portion.
Figure 8:
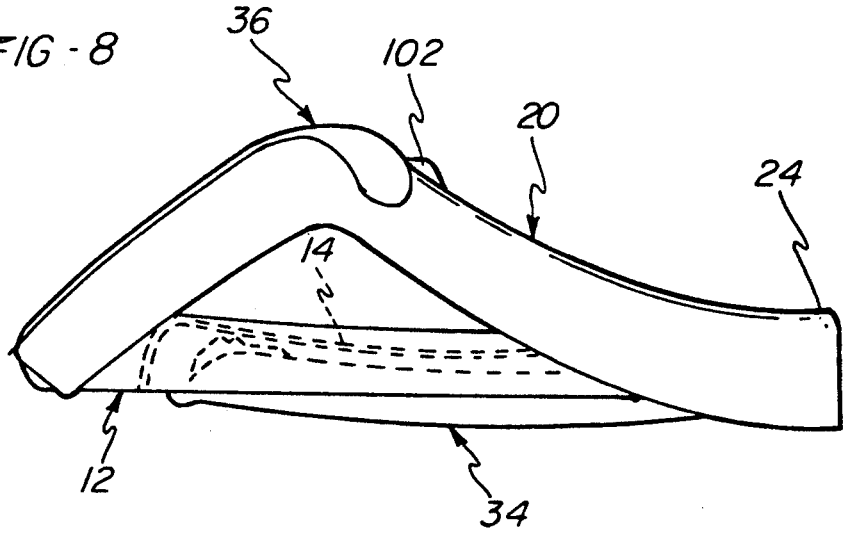
FIG. 8 is a side elevational view showing the bath ring in its compact storage configuration.

Referring to FIGS. 7 and 8, it can be seen that the rear post 34 may be pivoted from a support position in contact with the ring portion 20 to a storage position beneath the base portion 12. As seen in FIG. 4, in order to accommodate the pivotal movement of the rear post 34, the base portion 12 includes a pivot shaft 42 molded integrally with the base portion 12 and located within a rear slot 44 formed at the curved rear section 16. The lower end of the rear post 34 includes a slot 46 (see FIG. 3) which interconnects with the shaft 42 to form the pivot connection about which the rear post 34 pivots.

As may be seen in FIG. 4, the underside of the base portion 12 includes a pair of rib-like walls 46, 48 defining a slot 50 extending from the rear toward the front of the base portion 12 for receiving the rear post 34 in a storage position. In addition, a pair of base detents 52 extend inwardly from the walls 46, 48 and a pair of post detents 54 (see FIG. 2) extend outwardly from the rear post 34 for cooperating with the base detents 52 when the post 34 is located within the slot 50. Thus, as the post 34 is moved into position within the slot 50, the post detents 54 move past the base detents 52 such that the base detents 52 bias the post detents 54 upwardly to thereby hold the rear post 34 in its storage position, as shown in FIG. 8.

Figure 5:
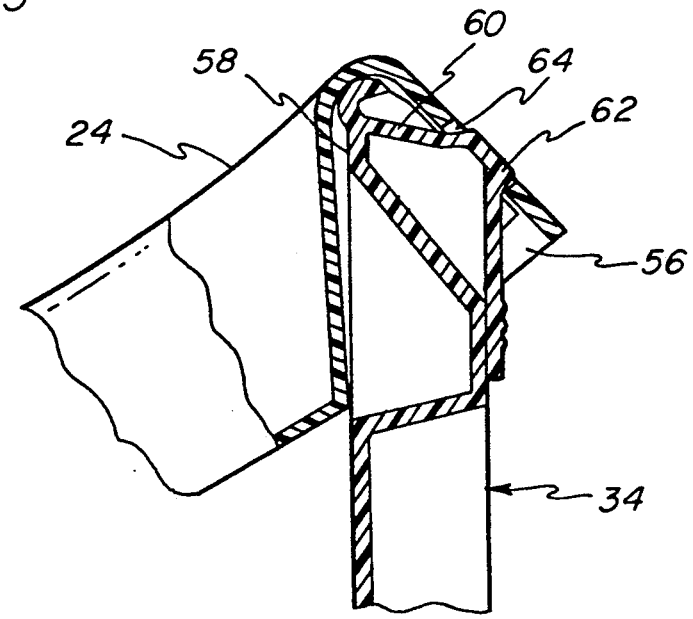
FIG. 5 is a side elevational partially cut-away view showing the engagement of the upper end of the support portion with the ring portion.

Referring to FIG. 5, a mechanism for holding the rear post 34 in interlocking engagement with the ring portion 20 is illustrated. The curved back section 24 of the ring portion 20 is provided with a downwardly facing groove 56 for receiving an upper end 58 of the rear post 34. The upper end 58 includes a resilient tongue member 60 molded integrally with the rear post 34 for resiliently supporting a tab or pawl member 62. The pawl member 62 is adapted to be received through a slot 64 formed in the back section 24 of the ring portion 20. Thus, the pawl member 62 and slot 64 cooperate in interlocking engagement to prevent relative movement between the ring portion 20 and the rear post 34, and the pawl member 62 may be moved forwardly out of engagement with the slot 64 to permit the ring portion 20 to move upwardly such that the rear post 34 may be moved into its storage position.

Referring to FIGS. 2 and 4, the base portion 12 is provided with a pair of pivot pins 66, 68 for engaging within apertures formed in the leg sections 30, 32 to thereby define attachment means for pivotally connecting the ring portion 20 to the base portion 12.

The base portion 12 is further provided with a central front slot area 74, and a pair of pivot studs 76, 78 extend inwardly into the front slot 74 for engaging the T-bar 36. The studs 76, 78 define a common pivot axis with the pivot pins 66, 68 such that the ring portion 20 and T-bar 36 may be pivoted together relative to the base portion 12 while the relative position between the ring portion 20 and T-bar 36 remains unchanged.

Referring to FIGS. 7 and 8, the arm sections 26, 28 of the ring portion 20 are provided with grooves 80, 82 for receiving and engaging end portions 84, 86 of the horizontal T-bar section 40. In order to disengage the end portions 84, 86 from the grooves 80, 82, the T-bar 36 must be first lifted slightly upwardly. Therefore, the T-bar 36 is provided with a pair of oval pivot sleeves 88, 100 (see also FIG. 3) for engaging the pivot studs 76, 78 wherein the T-bar 36 may pivot about the studs 76, 78 as well as move in a longitudinal direction along the length of the oval sleeves 88, 100.

Figure 6:
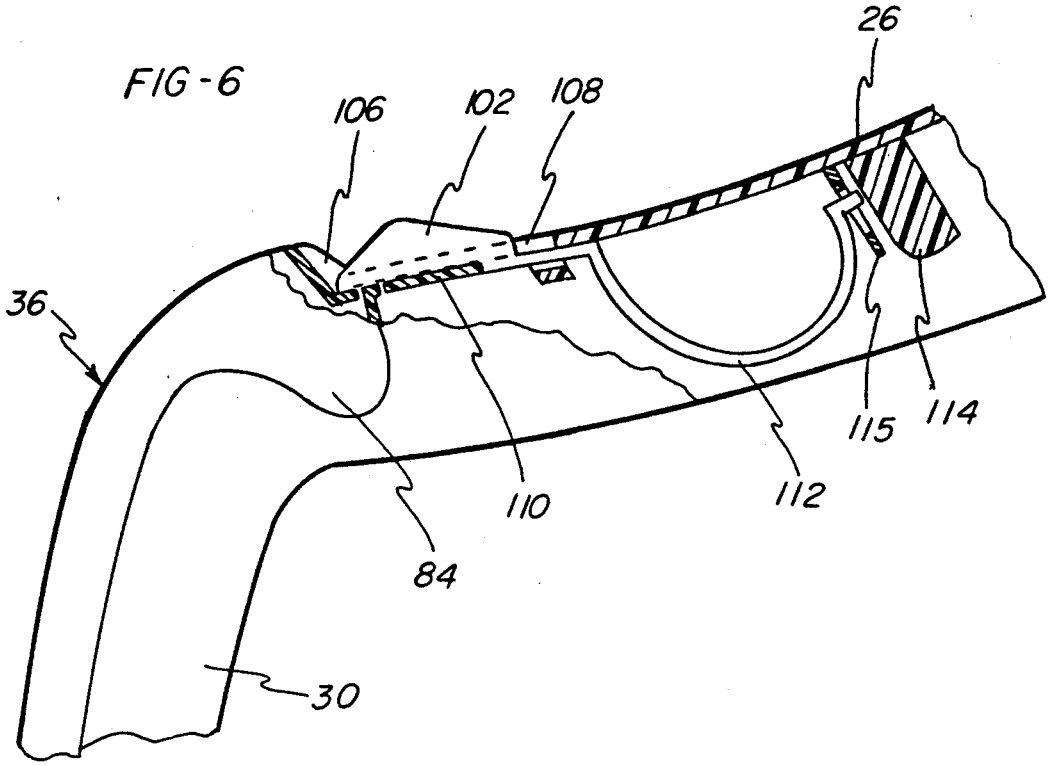
FIG. 6 is a side elevational partially cut-away view showing the locking mechanism for maintaining the T-bar in contact with the ring portion.

In order to maintain the engaging end portions 84, 86 in position within the grooves 80, 82, each of the arm sections 26, 28 is provided with a respective locking tab 102, 104. Referring to FIG. 6, the cooperation between the locking tab 102 and the end portion 84 is shown. The end portion 84 includes a locking recess 106 for receiving a forward end portion of the locking tab 102 such that the upward movement of the end portion 84 out of the groove 80 is prevented. The locking tab 102 extends upwardly through a slot 108 formed in an upper surface of the arm section 26 and includes a pair of outwardly extending tabs 110 for engaging an underside of the walls defining the slot 108 whereby the locking tab 102 is retained within the arm section 26. The locking tab 102 further includes a curved spring portion 112 which extends rearwardly into contact with an abutment structure formed by ribs 114, 115 formed integrally with the arm section 26. The spring portion 112 acts to bias the locking tab 102 forwardly and permits the tab 102 to be manually moved in a rearward direction in order to release the T-bar 36 for movement. Upon releasing the locking tab 102 from its rearward position, the spring portion 112 will bias the tab 102 forwardly to again extend over the groove 80.

It should be noted that the structure of the locking tab 104 for cooperating with the respective end portion 86 is substantially identical to that described with regard to the locking tab 102. Thus, release of the T-bar 36 from the ring portion 20 requires the two-step operation of moving the locking tabs 102, 104 rearwardly and then moving the T-bar upwardly out of contact with the grooves 80, 82.

It should be apparent from the above description that the present bath ring provides a rigid structure for supporting an infant in an upright sitting position wherein the infant's legs may pass outwardly on either side of the vertical section 38 of the T-bar 36, and that the horizontal T-bar section 40 provides a support for an infant to lean forwardly on while taking a bath. In addition, the first section 22 of the ring portion 20 as well as the rear post 34, provide side supports for surrounding the infant to the sides and the rear for ensuring that the infant remains in an upright sitting position.

It should further be apparent that providing the T-bar 36 as a forwardly swinging element, the infant may be placed on the upper surface 14 of the base portion 12 with the T-bar 36 in a non-obstructing forward position, and thereafter, the T-bar 36 may be swung upwardly into position for acting as a restraining bar in front of the infant.

It should also be apparent that the present bath ring 10 is adapted to be collapsed into a compact storage configuration, whereby the ring 10 may be stored using a minimum of space when it is out of use. This may be accomplished by disengaging the pawl member 62 from the slot 60 at the back of the ring portion 20 and lifting the ring portion 20 such that the rear post end 58 clears the groove 56. The rear post 34 may then be pivoted around into the slot 50 where the rear post 34 is retained by cooperating detents 52 and 54. Thereafter, the ring portion 20 and T-bar 36 may be moved as a unit in a rearward and downward direction until the curved back section 24 of the ring portion 20 surrounds the curved section 16 of the base portion 12 to provide a compact generally triangular configuration, as shown in FIG. 8.

Finally, it should be noted that the horizontal section 40 of the T-bar 36 may be provided with mounting points 116 for mounting various toys on the front of the bath ring 10 in order to entertain the infant while taking a bath. Further, it should be noted that the base portion 12 may be provided with a plurality of base studs 118 extending below the lower edge of the base portion 12 for engaging a support surface such as a conventional bathtub bottom. Further, conventional non-slip means such as suction cups may be mounted to the base studs to facilitate retaining the bath ring 10 in a preselected location within a bathtub.

While the form of apparatus herein described constitutes a preferred embodiment of the invention, it is to be understood that the invention is not limited to this precise form of apparatus, and that changes may be made therein without departing from the scope of the invention, which is defined in the appended claims.

What is claimed is:

1. A collapsible bath ring comprising:

a base portion defining an upper support surface for supporting a person seated on said bath ring;

a ring portion having a back portion for supporting the back of a person seated on said base portion;

attachment means connecting said ring portion to said base portion wherein said ring portion is adapted to pivot about said attachment means toward said base portion for collapsing said bath ring into a compact storage portion; and support means extending between said base portion and said ring portion to engage and support said ring portion at a location above said support surface in a support position of said support means.

2. The bath ring of claim 1 wherein said support means is movable to a non-support position to permit said ring portion to move about said attachment means.

3. The bath ring of claim 1 wherein said attachment means is located adjacent to a front edge of said base portion and said support means is attached adjacent to a rear edge of said base portion.

4. A collapsible bath ring comprising:

a base portion;

a ring portion having a back portion for supporting the back of a person seated on said base portion;

attachment means connecting said ring portion to said base portion wherein said ring portion is adapted to pivot about said attachment means toward said base portion for collapsing said bath ring into a compact storage position; and restraining means extending upwardly from a front edge of said base portion and engaging said ring portion.

5. The bath ring of claim 4 wherein said restraining means includes a T-shaped bar.

6. The bath ring of claim 1 including restraining means attached to a front edge of said base portion, said restraining means being mounted for pivotal movement relative to said base portion.

7. The bath ring of claim 6 wherein said ring portion includes a first section for surrounding a person seated on said base portion and a pair of second sections extending downwardly from said first section to said attachment means, a portion of said restraining means extending between and substantially parallel to said second sections.

8. The bath ring of claim 5 wherein said attachment means forms a pivot point for said ring portion, and said pivot point and said pivot connection for said restraining means are aligned on a common pivot axis.

9. A collapsible bath ring comprising:

a base portion for supporting a person;

a ring portion including a first section for surrounding a person seated on said base portion and a pair of second sections extending downwardly from said first section, said second sections including attachment means for engaging said base portion;

support means for supporting said first section in spaced relation to said base portion, said support means being movable to a non-support position to permit movement of said first section toward said base portion into a compact storage position; and wherein said first section of said ring portion is adapted to be located adjacent to and extending around a back portion of a peripheral edge of said base portion in said compact storage position.

10. The bath ring of claim 9 including a bar attached to said base portion between said second sections.

11. The bath ring of claim 10 wherein said bar includes first and second bar portions, said second bar portion being oriented perpendicular to said first bar portion.

12. The bath ring of claim 10 wherein said bar is mounted for pivotal movement relative to said base portion and said second portion is adapted to engage with and disengage from said ring portion.

13. The bath ring of claim 9 wherein said base portion includes a lower portion and means defining a slot on said lower portion, and said support means is adapted to be pivoted into engagement with said slot.

14. The bath ring of claim 9 wherein said support means is attached to said base portion at a pivot connection located at said back portion of said peripheral edge of said base portion.

15. The bath ring of claim 9 wherein said support means is oriented substantially perpendicular to said base portion for engaging said ring portion when said support means is positioned to support said ring portion.

16. A collapsible bath ring comprising:

a base portion including a lower portion for engaging a surface to support said bath ring and an upper surface for supporting a person sitting in an upright position on said bath ring, said base portion defining a front edge and an opposing rear edge for said bath ring;

a ring portion including a curved back section, first and second arm sections extending forwardly from said back section, and first and second leg sections extending downwardly from said first and second arm sections, respectively;

attachment means coupling said first and second leg sections to said base portion adjacent to said front edge, said attachment means forming a pivotal connection between said ring portion and said base portion;

a T-bar including a vertical section having a first end attached to said base portion at a pivot connection between said first and second leg sections, and a second end attached to a horizontal section of said T-bar, said T-bar;

locking means located on said ring portion, said locking means being mounted for sliding movement toward and away from a locking surface on said horizontal section of said T-bar, said locking means cooperating with said locking surface in interlocking engagement to prevent relative movement between said T-bar and said ring portion;

a rear post extending from said curved back section to a pivot connection with said base portion at said rear edge, said rear post including a pawl mounted for movement on a resilient support;

means defining a slot in said curved back section for receiving said pawl in interlocking engagement to prevent relative movement between said curved back section and said rear post;

means defining a storage slot in a lower portion of said base portion, said storage slot extending from said rear edge toward said front edge; and wherein said T-bar and said rear post are adapted to be disengaged from said ring portion and said rear post is adapted to be pivoted into engagement with said storage slot in said base portion such that said bath ring may be collapsed into a compact storage position.

* * * * *